United States Patent [19]

van Olphen

[11] Patent Number: 4,951,483

[45] Date of Patent: Aug. 28, 1990

[54] DO-IT YOURSELF TYE-DYE KIT APPARATUS AND METHOD

[76] Inventor: Beatrice T. van Olphen, 8255 E. Rockgate, Tucson, Ariz. 85715

[21] Appl. No.: 335,510

[22] Filed: Apr. 10, 1989

[51] Int. Cl.[5] ..... B65D 81/36; D06B 11/00

[52] U.S. Cl. ..... 68/213; 8/482; 206/568; 206/575

[58] Field of Search ..... 8/148, 149, 150, 482; 68/213, 235 R; 206/568, 575, 578; 28/163, 164

[56] References Cited

U.S. PATENT DOCUMENTS 3,840,113 10/1974 Bartleson ..... 206/575

FOREIGN PATENT DOCUMENTS 9059965 4/1984 Japan ..... 8/482

OTHER PUBLICATIONS

*Redbook,* vol. 135, No. 2, "A Little Guide to Tie-Dyeing", Cover Page & pp., 6, 81, 172, 174 & 176, Jun. 1970.

*School Arts,* vol. 68, No. 9, "We Tied and Dyed", Contents page & pp. 18 & 19, May 1969.

*Marketing,* "Profit Hint: Always Say Dye", p. 71, Jan. 1970.

*Primary Examiner*—Philip R. Coe

*Attorney, Agent, or Firm*—Victor Flores

[57] ABSTRACT

The kit apparatus of the present invention includes a tye-dye instruction manual for instructing a user how to tye-dye an article of clothing. The manual contains a variety of illustrated tye-dye patterns including a finished product state for selection by a user, at least one article of clothing for being tye-dyed and tye-dyeing supplies for tye-dyeing the article of clothing. The tye-dyeing supplies include: soaking solution for soaking the article of clothing prior to dyeing, dyestuff material for preparing a dyeing solution, glove means for safe handling of the soaking solution and dyestuff material, a plurality of rubber bands for banding the article of clothing to create dye diffusion regions according to a tye-dye pattern selected from said illustrated tye-dye patterns, and a squeeze dropper applicator for applying said dyestuff material to said article of clothing.

5 Claims, 4 Drawing Sheets

DO-IT YOURSELF TYE-DYE KIT APPARATUS AND METHOD

FIELD OF THE INVENTION

The present invention relates to do-it-yourself kits, more particularly, the present invention relates to do-it-yourself kit apparatus for dyeing an article of clothing. Yet more particularly, the present invention relates to dye kit apparatus and methods for do-it-yourself users in the art of tye-dyeing an article of clothing.

DESCRIPTION OF THE PRIOR ART

While the art of dyeing an article of clothing by a do-it-yourself user is known in the sense of a user purchasing a single color dye and dyeing an article of clothing using the single color, the applicant is not aware of any kit apparatus that can be purchased that provides instruction along with the means to dye an article of clothing in a variety of colors and patterns. It is also known, at an industry level, to provide articles of clothing having patterns with multi-colors by using fabric clamping techniques. U.S. Pat. No. 3,975,151 teaches the art of producing multicolored patterns on fabrics using a clamped folded fabric dyeing method. The '151 Patent teaches that specially shaped plates and clamps are needed and does not suggest any means by which the method could be practiced by a do-it-yourself user on an article of clothing. Further the '151 Patent is believed to address industrial applications for dyeing fabric not already shaped into articles of clothing. The '151 patent does, however, teach the dyestuff diffusion principles that explain the color patterns resulting from dyeing a clamped fabric and includes as dye solution recipes that may be employed in the dyeing process. Other teachings of dyeing fabric using clamping techniques include U.S. Pat. No. 2,107,536 that teaches the use of clamping and cover techniques to vary the intensity of the treatment, U.S. Pat. No. 3,644,969 directed at a process for the continuous production of a crimped colored yarn in which the yarn is simultaneously crimped and heterogeneously dyed. U.S. Pat. No. 2,273,305 teaches diffused colorations on textiles and other material.

Thus, while the art of diffused color dyeing is known, methods of employing the art are directed at industrial applications where the fabric is in hanks or skeins or at various cut stages not yet formed into articles of clothing. The prior art does not teach the means for a do-it-yourself user to practice the diffused color dyeing art on manufactured articles of clothing. Therefore, a need is believed to exist for a kit apparatus and method that enables a user to practice the art of diffused color dyeing, or tye-dyeing as referred to by applicant, on manufactured articles of clothing.

SUMMARY OF THE INVENTION

Therefore, the primary object of this invention is to provide an inexpensive tye-dyeing kit apparatus and method whereby a do-it-yourself user can practice the art of tye-dyeing a manufactured articles of clothing.

The kit apparatus of the present invention, in the preferred embodiment, comprises a tye-dye instruction manual for instructing a user how to tye-dye said article of clothing, said manual having a plurality of illustrated tye-dye patterns including a finished product state for selection by a user, at least one article of clothing for being tye-dyed and tye-dyeing supplies for tye-dyeing said article of clothing. The tye-dyeing supplies include: soaking solution for soaking said article of clothing prior to dyeing, dyestuff material for preparing a dyeing solution, glove means for safe handling of said soaking solution and said dyestuff material, a plurality of rubber bands for banding the article of clothing to create dye diffusion regions according to a tye-dye pattern selected from said illustrated tye-dye patterns, and a squeeze dropper applicator for applying the dyeing solution to the article of clothing. Since the manual of the preferred embodiment is an instructional information source, alternative information sources, such as video cassettes, may be used to visually illustrate to a do-it-yourself the tye dyeing process and using the dyeing supplies.

Therefore, to the accomplishments of the foregoing objects, the invention consists of the foregoing features hereinafter fully described and particularly pointed out in the claims, the accompanying drawings and following disclosure describing in detail the invention, such drawings and disclosure illustrating, however, but one of the various ways in which the invention may be practiced.

DESCRIPTION OF THE PREFERRED EMBODIMENT

Figure 1:
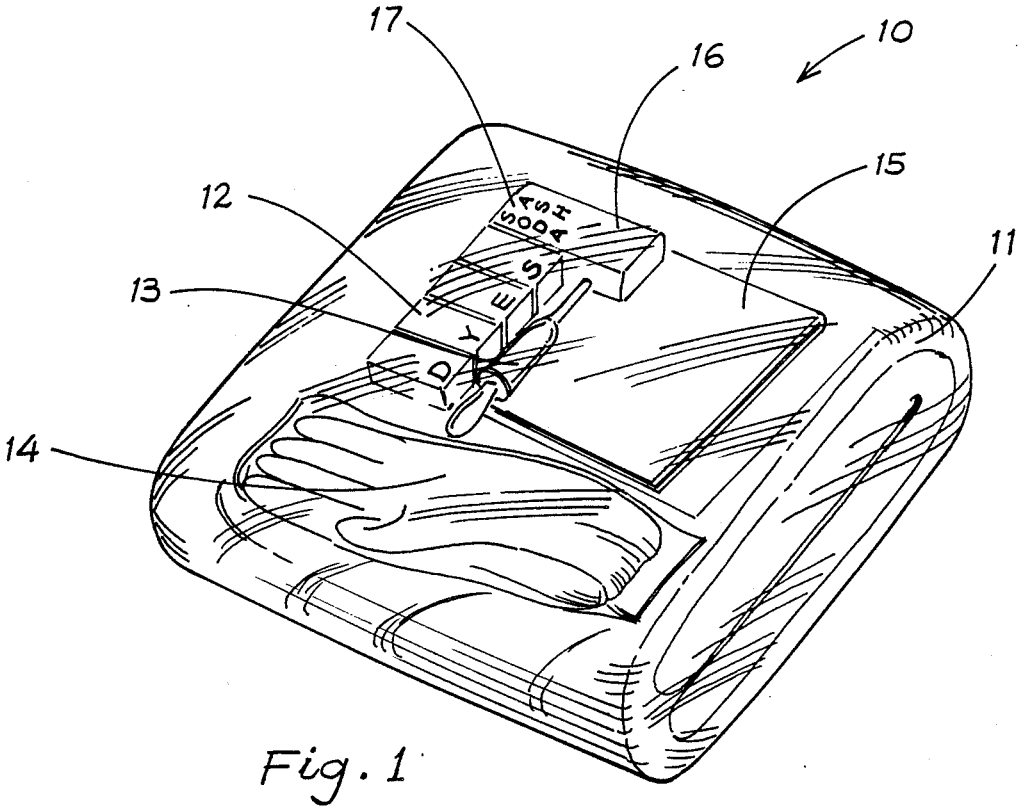
FIG. 1 is a perspective view of the packaged kit apparatus of the present invention, consisting of an article of clothing, an instruction manual, packages of dye, soaking solution, rubber bands and gloves for safe handling.

Referring now to FIG. 1, the present invention discloses a packaged tye-dye kit apparatus 10 comprising an article of clothing 11, packages of dye 12, applicator means 13, gloves 14, instruction manual 15, rubber bands 16 and soda ash 17 for use as a soaking solution. The packages of dye 12 are preferably four pre-mixed packages of a dyestuff mixture consisting of a 1:1 mixture by volume of the four primary colors of yellow, red, blue and black and urea. The primary colors are selected according to industry standard indexing for dyes and colors and may be purchased under the PROCION trademark. The soda ash 17 is a washing soda, soaking solution and is used to pre-soak article for clothing 11 before dyeing. The gloves 14 are preferably made of synthetic rubber, generally referred to as surgical gloves and are provided to prevent direct contact with the dyestuff and soaking solution to prevent inadvertent chemical reaction or skin color staining. The applicator 13 is preferably a squeeze dropper device that can be used to control the flow of the dye solution onto the banded article of clothing 11. The article of clothing 11 is arbitrary, but preferably is a tee shirt made from 100% cotton fabric. The cotton fabric has exhibited the best dye diffusion results and is also preferably white for producing a colorful pattern. The instruction manual 15 provides illustrations of a plurality of colored patterns that may be achieved using the tye-dye method. Each pattern includes the illustrated steps for soaking, manipulating the article of clothing, the banding and application of the dye. The instruction manual also provides a plurality of recipes for obtaining color variations of the primary colors, i.e. secondary colors as well as safety precautions in handling the material.

EXAMPLE

Figure 2:
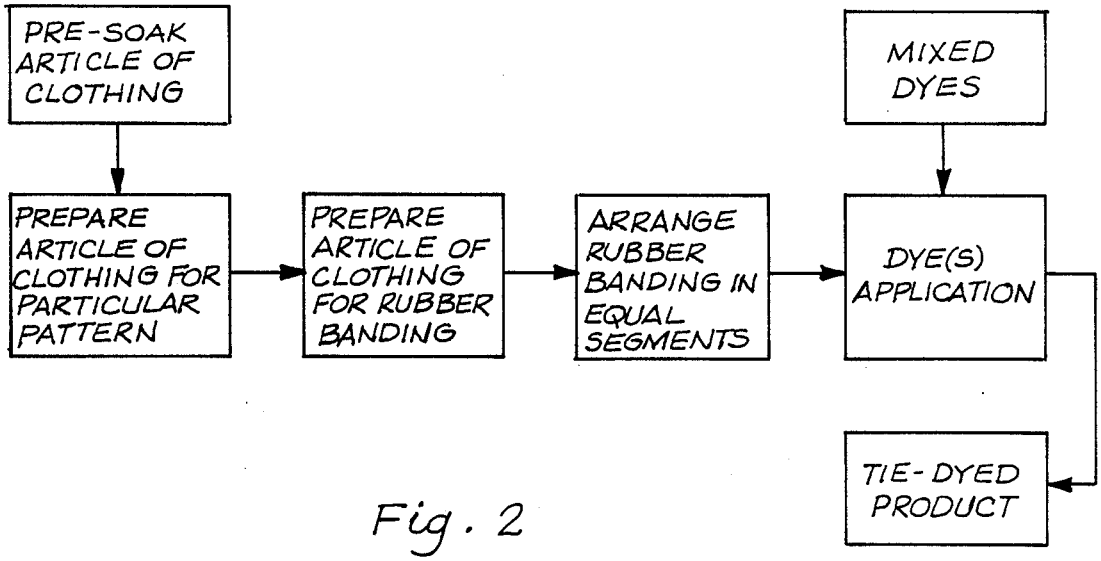
FIG. 2 is a block diagram of the do-it-yourself tye-dye process.
Figure 3:
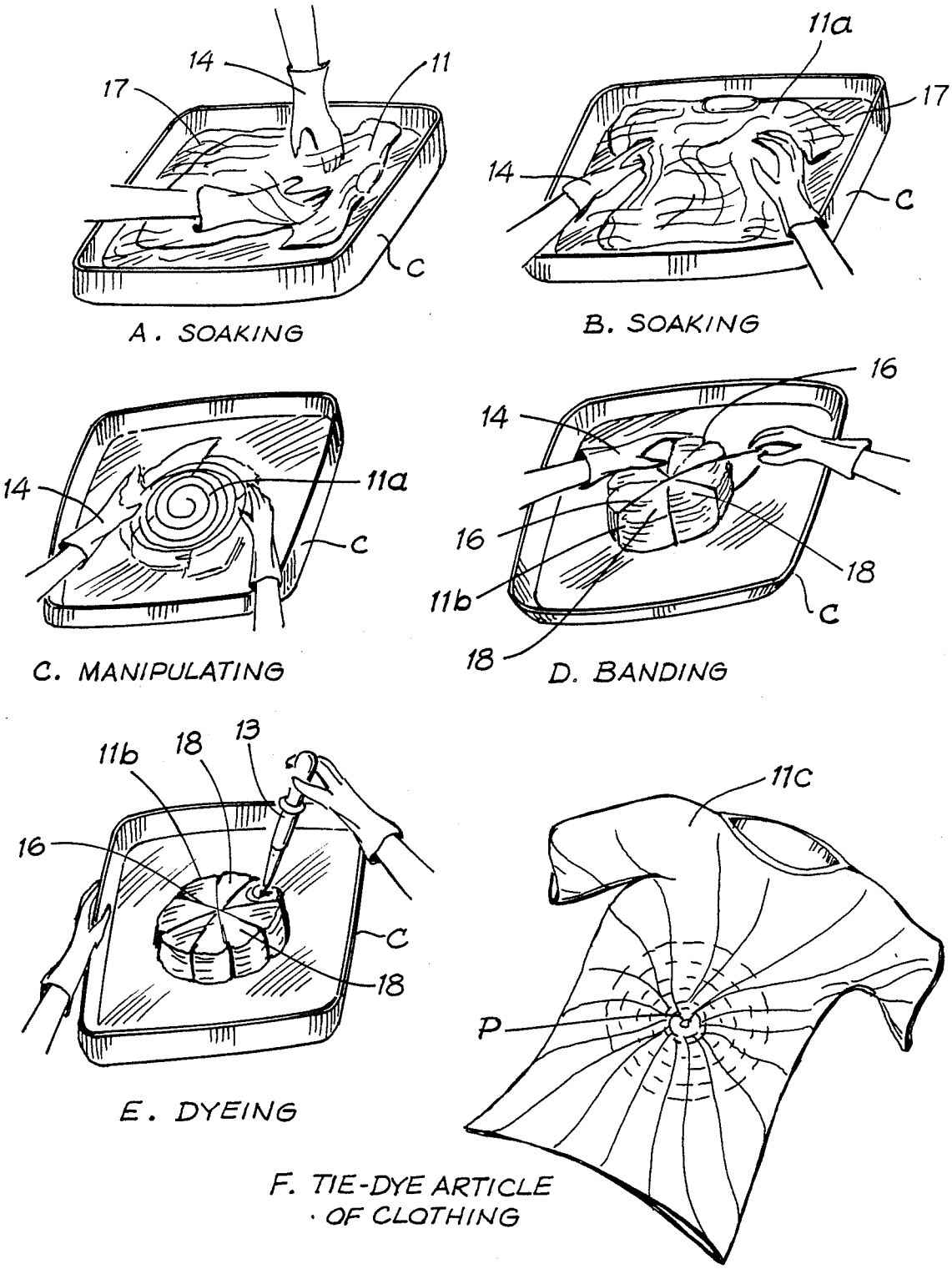
FIG. 3 is an illustrated perspective view of the soaking (FIGS. 3A. and 3B.), manipulating (FIG. 3C), banding (FIG. 3D.), and dyeing (3E.) steps required in producing a tye dyed article of clothing (FIG. 3F.).
Figure 3A:
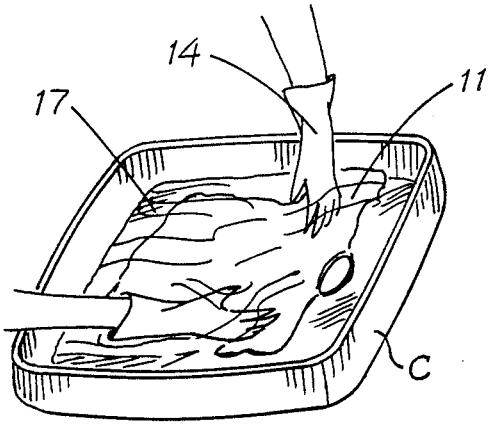
Figure 3B:
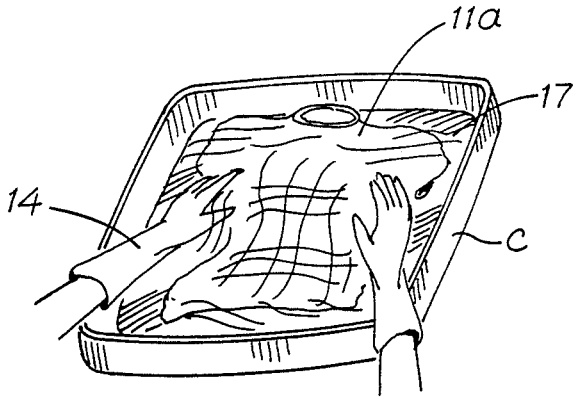
Figure 3C:
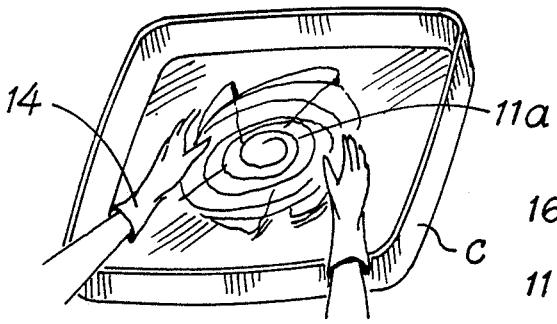
Figure 3D:
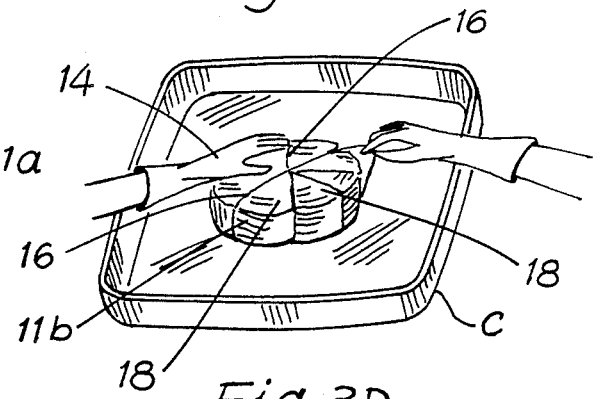
Figure 3E:
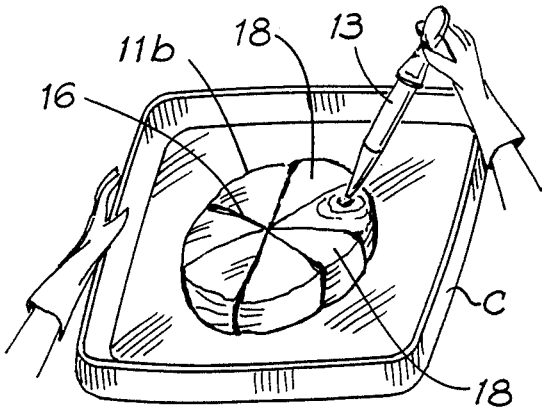
Figure 3F:
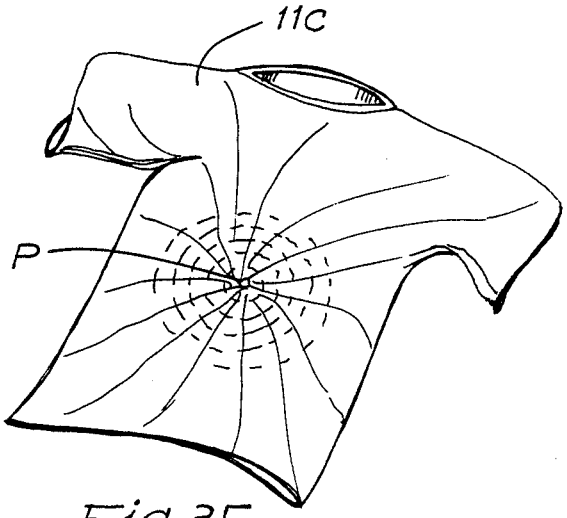

Referring now to FIG. 2 and FIGS. 3(A.–F.), a do-it-yourself user is provided with a tye-dye kit apparatus 10. After inspection the user selects from the instruction manual 15 a particular pattern P (a spiral pattern shown in FIG. 3F. for illustration purposes only) to be dyed onto the article of clothing 11. Following the steps illustrated in FIG. 2, the user then proceeds to prepare a soaking solution using soda ash 17 mixed in the proportions of 10 grams of soda ash and one half (½) gallon of water in an appropriate container C. The user also prepares a dye solution using 2 teaspoons of a selected primary color or secondary color combination dissolved in one cup of warm water (approximately 100 degrees F.). The user then takes safety precautions using gloves 14 and commences to presoak the article of clothing 11 as illustrated in FIGS. 3A and 3B. The user then manipulates the pre-soaked article of clothing 11*a* in preparation for banding in accordance with the required manipulating procedures to produce a particular pattern P, selected from instruction manual 15. For example, the manipulations may include twisting and folding the presoak article of clothing 11*a* to produce a spiral pattern P as illustrated in FIG. 3F. Once the manipulation of the presoaked article of clothing 11*a* is completed, then rubber bands 16 are symmetrically placed around the presoaked article of clothing 11*a* to provide dye diffusion regions 18 as illustrated in FIG. 3D. The actual dyeing step may involve several containers of dye solutions mixed as stated above to obtain all colors contained in the selected pattern P. As illustrated in FIG. 3E, the dyes are applied, in a saturated manner, to the banded article of clothing 11*b* using squeeze dropper 13. The completed tye-dyed article of clothing 11*c* is illustrated in FIG. 3F.

Figure 4:
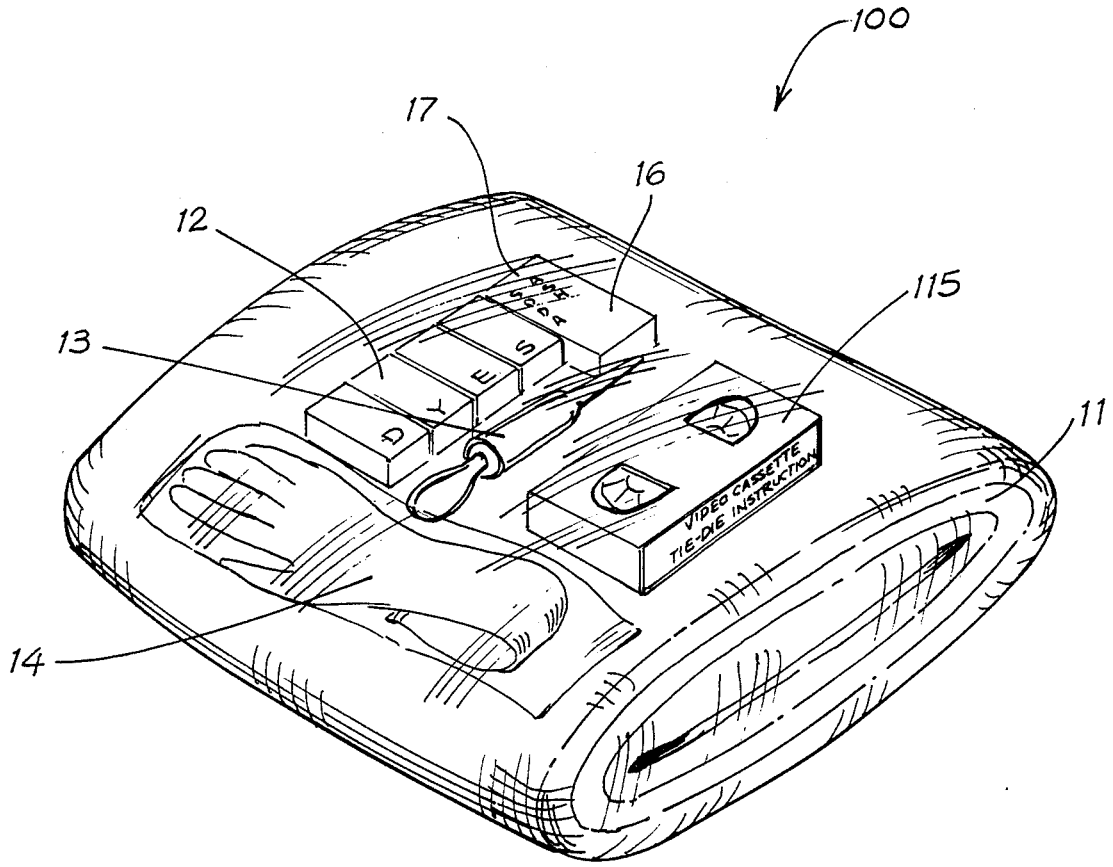
FIG. 4 is a perspective view of an alternative packaged kit apparatus of the present invention, consisting of an article of clothing, a video cassette instructional material, packages of dye, soaking solution, rubber bands and gloves for safe handling.

While in the preferred embodiment the instructional source for teaching the tye-dyeing process for dyeing an article of clothing contemplates an instructional manual, it is also possible to teach the tye-dyeing process by using a video cassette. FIG. 4 shows an alternative packaged kit apparatus 100 consisting essentially of the same material as kit apparatus 10 except that a video cassette 115 is included as the informational source means. The video recording would show an actor teaching the process from unpackaging the kit, selecting a particular multi-colored pattern, mixing the dyes, soaking the article of clothing, manipulating the article of clothing in preparation for dyeing the selected multi-colored pattern, banding the article of clothing.

Therefore, while the present invention has been shown and described herein in what is believed to be the most practical and preferred embodiments, it is recognized that departures can be made therefrom within the scope of the invention, which is therefore not to be limited to the details disclosed herein but is to be accorded the full scope of the claims so as to embrace any and all equivalent apparatus.

I claim:

1. A composite, ready-to-use, do-it-yourself tye-dye kit apparatus for producing a tye-dye pattern on an article of clothing, said composite, ready-to-use, do-it yourself tye-dye kit apparatus comprising:

tye-dye instruction information source for instructing a user how to tye-dye said article of clothing, said information source having a plurality of illustrated tye-dye patterns in a finished product state for selection and for being duplicated by a user onto said article of clothing; and ready-to-use tye-dyeing supplies included with said instruction information source for tye-dyeing said article of clothing.

2. A composite, ready-to-use, do-it-yourself tye-dye kit apparatus as recited in claim 1, further including:

at least one article of clothing included with said instruction information source and said ready-to-use tye-dyeing supplies; and wherein said tye-dyeing supplies includes: soda ash soaking solution for soaking said article of clothing prior to dyeing, dyestuff material in at least one color dye, and glove means for safe handling of said soaking solution and said dyestuff material.

3. A composite, ready-to-use, do-it-yourself tye-dye kit apparatus for producing a tye-dye pattern on an article of clothing, said composite, ready-to-use, do-it yourself tye-dye kit apparatus comprising;

(a) type-dye instruction booklet for instructing a user how to tye-dye said article of clothing, said booklet having a plurality of illustrated tye-dye patterns in a finished product state for selection and for being duplicated by a user onto said article of clothing;

(b) at least one article of clothing included with said instruction booklet for being tye-dyed; and (c) ready-to-use tye-dyeing supplies included with said booklet and said article of clothing for tye-dyeing said article of clothing, said type-dyeing supplies including:

(i) soda ash soaking solution for soaking said article of clothing prior to dyeing, (ii) dyestuff material in at least one color dye, (iii) glove means for safe handling of said soaking solution and said dyestuff material, (iv) a plurality of banding material for tyeing said article of clothing according to a tye-dye pattern selected from said illustrated tye-dye patterns, and (v) applicator means for applying said dyestuff material to said article of clothing.

4. A composite, ready-to-use, do-it-yourself tye-dye kit apparatus for producing a tye-dye pattern on an article of clothing, said composite, ready-to-use, do-it yourself kit apparatus comprising in combination:

at least one T-shirt article of clothing;

an illustrated, step-by-step instruction booklet having a plurality of tye-dye patterns for being selected and duplicated onto said T-shirt by a user; and ready-to-use tye-dyeing supplies for tye-dyeing said at least one T-shirt, said supplies including: (i) soda ash soaking solution for soaking said at least one T-shirt prior to dyeing, (ii) dyestuff material consisting of a plurality of individual color dye packages, and (iii) glove means for safe handling of said soaking solution and said dyestuff material.

5. A composite, ready-to-use, do-it-yourself tye-dye kit apparatus for producing a tye-dye pattern on an article of clothing, said kit apparatus comprising in combination:

at least one T-shirt article of clothing;

a videotape showing step-by-step visual instructions of how a user can tye-dye said at least one T-shirt and duplicate a selected one of a plurality of tye-dye patterns onto said T-shirt; and ready-to-use tye-dyeing supplies for tye-dyeing said at least one T-shirt, said supplies including: (i) soda ash soaking solution for soaking said at least one T-shirt prior to dyeing, (ii) dyestuff material consisting of a plurality of individual color dye packages, and (iii) glove means for safe handling of said soaking solution and said dyestuff material.

* * * * *